US006239539B1

(12) United States Patent
Mochiduki et al.

(10) Patent No.: US 6,239,539 B1
(45) Date of Patent: May 29, 2001

(54) ELECTRIC DISCHARGE LAMP APPARATUS AND INSULATING PLUG THEREFOR HAVING A PARTICULAR FRONT PORTION

(75) Inventors: Kunimasa Mochiduki; Masato Harazaki; Yasuyoshi Numajiri; Takeshi Fukuyo; Yoshitaka Ohshima; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/201,808

(22) Filed: Dec. 1, 1998

(30) Foreign Application Priority Data

Dec. 11, 1997 (JP) ..... 9-341144

(51) Int. Cl.[7] ..... H01J 5/48; H01J 5/50

(52) U.S. Cl. ..... 313/318.01; 313/318.02; 313/318.09; 313/25

(58) Field of Search ..... 313/318.01, 318.02, 313/318.09, 25

(56) References Cited

U.S. PATENT DOCUMENTS

| | | | | |
|---|---|---|---|---|
| 5,059,855 | | 10/1991 | Irisawa et al. | 313/318 |
| 5,250,872 | | 10/1993 | Wakimizu et al. | 313/25 |
| 5,463,270 | * | 10/1995 | Wakimizu et al. | 313/318.01 |
| 5,627,428 | * | 5/1997 | Helbig et al. | 313/318.01 |
| 5,736,811 | | 4/1998 | Westemeyer et al. | 313/318.02 |
| 5,742,114 | | 4/1998 | Kohl et al. | 313/318.01 |
| 5,757,110 | | 5/1998 | Motiduki et al. | 313/25 |

FOREIGN PATENT DOCUMENTS

| | | | |
|---|---|---|---|
| 210 506 | 6/1984 | (DE) | H01R/33/08 |
| C1 33 29 475 | 2/1985 | (DE) | H01R/33/22 |
| A1 196 16 409 | 10/1997 | (DE) | H01K/1/46 |
| A2 0 696 046 | 7/1995 | (EP) | H01J/5/54 |
| A1 0 786 791 | 1/1997 | (EP) | H01J/5/56 |
| A1 0 786 791 | 7/1997 | (EP) | H01J/5/56 |
| 2 389 231 | 2/1978 | (FR) | H01K/1/44 |
| 2 275 567 | 8/1994 | (GB) | H01J/9/30 |

* cited by examiner

*Primary Examiner*—Vip Patel
*Assistant Examiner*—Kevin Quarterman
(74) *Attorney, Agent, or Firm*—Sughure, Mion, Zinn, Macpeak & Seas, PLLC

(57) ABSTRACT

An insulating plug for an electric discharge lamp apparatus, includes: a front portion includes an outer cylindrical portion and an inner cylindrical portion, the inner cylindrical portion having a substantially unique thickness and an opening to receive an arc tube of an electric discharge lamp; a focusing ring extending from the outer cylindrical portion of the front portion; and a rear portion having a rear-end cylindrical portion and a center portion. The front portion, the focusing ring and the rear portion are integrally molded by injecting a synthetic resin into a mold from a gate of the mold, the gate facing the rear-end cylindrical portion of the rear portion of the insulating plug. Furthermore, the electric discharge lamp apparatus in which an arc tube is inserted into the opening of the insulating plug described above.

16 Claims, 11 Drawing Sheets

ELECTRIC DISCHARGE LAMP APPARATUS AND INSULATING PLUG THEREFOR HAVING A PARTICULAR FRONT PORTION

BACKGROUND OF THE INVENTION

The present invention relates to an insulating plug for an electric discharge lamp apparatus having a structure in which a lamp-side connector, to which a connector for supplying electric power can be connected and disconnected, is integrally provided for the rear end of the main body of an insulating plug having a front end to which an arc tube is secured and held.

As shown in FIG. 15, a conventional electric discharge lamp apparatus has a structure that an arc tube 3 is, through a metal lead support 2*a* and a ceramic disc 2*b*, integrally secured to the front end of an insulating plug body (an insulating base) 1 made of synthetic resin.

Note that a hole, through which a rear end of the arc tube is inserted, is formed in the front surface of the insulating plug body 1.

The arc tube 3 has a structure that an ultraviolet-ray shielding globe 5 is, by welding, integrated with an arc tube body 4 having an enclosed glass bulb 4*a* which is a light emitting portion in which electrodes 4*b* are disposed opposite to each other. Thus, the enclosed glass bulb 4*a* is surrounded and hermetically sealed by the ultraviolet-ray shielding globe 5. The electrodes 4*b* are connected to lead wires 4*e* extending from the arc tube 3 through molybdenum foil members 4*d* bonded to pinch seal portions 4*c*.

On the other hand, a cylindrical portion 1*a* extending rearward is formed at the rear end of the insulating plug body 1. A belt-shape negative-side terminal 6 electrically connected to a front-end lead wire of the arc tube 3 through a lead support 2*a* is exposed on the outer surface of the cylindrical portion 1*a*. In the central portion of the cylindrical portion 1*a,* a positive-side terminal 7 electrically connected to a rear-end lead wire of the arc tube 3 is exposed. The foregoing elements (the cylindrical portion 1*a,* the terminal 6 and the terminal 7) constitute a lamp-side connector C2 to which a connector C1 for supplying electric power can be connected and disconnected.

A ceramic insulating sleeve 2*c* is fitted to a lead support 2*a* forwards projecting over the insulating plug body 1. Thus, insulation between a lead support 2*a* which is a positive-side passage for electric power and a lead wire at the rear end of the arc tube 3 is maintained, the rear-end lead wire being a positive-side passage for electric power.

As shown in FIG. 16, the insulating plug body 1 is formed by injection molding such that the front end surface having a relatively large thickness of the insulating plug body 1 faces a gate 9 of the molds 8*a* and 8*b*. A slide mold 8*c* is provided for forming a recessed groove for receiving a negative-side terminal 6 which is formed into an undercut portion.

However, the conventional insulating plug 1 has a problem in that hollow portions B (hereinafter called "voids") which cause dielectric breakdown are formed at the base portion of the rear-end cylindrical portion 1*a*.

The inventors of the present invention have conducted investigations, resulting in the following fact being detected. Resin injected through the gate 9 is introduced from the front-end cylindrical portion into the rear-end cylindrical portion 1*a* so that the cylindrical portion 1*a* is filled with the resin. In the rear-end cylindrical portion 1*a* which is apart from the gate 9 and which has a large thickness, resin cannot sufficiently be supplied. Moreover, the molding pressure in the foregoing portion is made to be lower than that in the portions in the vicinity of the gate 9. Therefore, gas cannot sometimes sufficiently be removed. The resin injected into the cavity is solidified such that the peripheral portion which is brought into contact with the mold is first solidified. In the thick wall portions, contraction and solidification occur slowly as compared with thin wall portions when the molding process is performed. Therefore, resin is pulled by the peripheral portion which has first been contracted and solidified and, therefore, deformation takes place. Thus, an estimation is made that voids B are formed.

Therefore, the inventors have formed an inner cylindrical portion and a cylindrical portion for surrounding the inner cylindrical portion which are provided for the front end portion of the insulating plug. Thus, the thickness of the overall portion from the front end portion of the insulating plug body to the base portion is reduced as compared with that of the conventional structure so that a uniform thickness is realized. In addition, the extending end surface of the rear-end cylindrical portion 1*a* having the largest thickness in the insulating plug body 1 is caused to face the gate 9. As a result, no void was observed in the overall portion of the insulating plug body 1 including the inside portion of the rear-end cylindrical portion 1*a* and the front-end cylindrical portion (the inner cylindrical portion and the outer cylindrical portion).

The present invention is established to solve the above-mentioned problems experienced with the conventional technique and on the basis of the facts detected by the inventors.

SUMMARY OF THE INVENTION

An object of the present invention is to provide an insulating plug for an electric discharge lamp apparatus, the weight and cost of which can be reduced, and in which insulation can be maintained.

To achieve the above-mentioned object, an insulating plug for an electric discharge lamp apparatus according to the present invention includes a front portion having an outer cylindrical portion and an inner cylindrical portion, the inner cylindrical portion having a substantially unique thickness and an opening to receive an arc tube of an electric discharge lamp; a focusing ring extending form the outer cylindrical portion of the front portion; and a rear portion having a rear-end cylindrical portion and a center portion, wherein a thickness t1 of the rear-end cylindrical portion of the rear portion, and the thickness t2 of the inner cylindrical portion of the front portion satisfy a following condition:

$$t1>t2.$$

Preferably, the thickness t1 of the rear-end cylindrical portion of the rear portion, the thickness t2 of the inner cylindrical portion of the front portion and a thickness t3 of the outer cylindrical portion of the front portion satisfy a following condition: $t1>t2>t3$.

The thickness of the insulating plug is enlarged in a direction toward the gate. That is, the passage in the cavity through which the resin flows is widened toward the gate. Therefore, the resin can smoothly be introduced into the overall body of the cavity. Also the injection molding pressure can be uniformed in the overall body of the cavity.

The rear-end cylindrical portion has the largest thickness t1 in the overall body of the insulating plug. Thus, insulation can be maintained between the belt-shape negative terminal exposed on the outer surface of the rear-end cylindrical portion and the positive terminal exposed in the center portion in the cylindrical portion. Moreover, the mechanical strength which endures connection and disconnection of the connector for supplying electric power can be realized.

The front-end cylindrical portion has the next largest thickness t2 in the overall body of the insulating plug to that of the rear-end cylindrical portion. Therefore, insulation between the positive-side passage (the rear-end lead wire of the arc tube) for electric power disposed on the inside of the inner cylindrical portion and the negative-side passage (electricity carrying members, such as, a lead support, which are electrically connected to the front-end lead wire of the arc tube) disposed on the outside of the inner cylindrical portion can be maintained. Moreover, the mechanical strength can be realized to reliably secure and hold the rear end portion of the arc tube.

Since the outer cylindrical portion of the front portion is a portion which does not considerably affect the insulation, the foregoing portion has the thickness t3 which is the smallest thickness in the insulating plug. Therefore, a large space is formed between the outer cylindrical portion and the inner cylindrical portion of the front portion. Moreover, the mechanical strength can be realized to integrally support the focusing ring which is received in a valve receiving hole of a reflector for a headlamp for an automobile.

According to another aspect of the invention, there is provided the insulating plug described above, wherein the front portion, the focusing ring and the rear portion are integrally molded by injecting a synthetic resin into a mold from a gate of the mold, the gate facing the rear portion of the insulating plug.

Preferably, in the insulating plug, the gate faces the rear-end cylindrical portion of the rear portion of the insulating plug.

The cylindrical portion is formed adjacent to the rear portion, while the inner cylindrical portion and the outer cylindrical portion are formed adjacent to the front portion. The overall body of the insulating plug body has substantially the same thickness. Therefore, the insulating plug body is free from any excessively thick wall portion as has been formed in the conventional insulating plug. Therefore, the overall body of the insulating plug can substantially uniformly be contracted and solidified. Thus, there is no apprehension that a void is formed in the insulating plug body.

The molding process is performed such that the rear-end cylindrical portion having the largest thickness in the insulating plug body faces the gate of the mold. Therefore, resin injected into the cavity through the gate can smoothly be introduced from the rear-end cylindrical portion having the large thickness to the inner cylindrical portion and the outer cylindrical portion. As a result, a sufficiently high molding pressure can be obtained in any region.

The space opened forwards is provided for the inner cylindrical portion and the outer cylindrical portion which constitute the front portion of the insulating plug body. Thus, synthetic resin material corresponding to the space region can be saved and thus the overall weight can be reduced.

According to yet another aspect of the invention, the resin is injected from plural gates which face to the rear portion of the insulating plug, and which are formed at even intervals.

Resin injected into the cavity through each gate of the mold flows uniformly in the circumferential direction in the rear-end cylindrical portion toward the front portion. Also in the front portion, namely, the inner cylindrical portion and the outer cylindrical portion, resin flow uniformly in the circumferential direction toward the front end. Therefore, charging of resin can smoothly be performed. Moreover, the molding pressure can be uniformed in the overall body of the plug.

According to a further aspect of the invention, there is provided the insulating plug described above, further comprising: a first electric terminal exposed around the rear-end cylindrical portion of the rear portion, wherein the first electric terminal is made of an electric conductive material; and a second electric terminal exposed around the center portion of the rear portion, wherein the second electric terminal is made of an electric conductive material, and at least the first electric terminal is integrated with the insulating plug at injecting the synthetic resin into the mold.

Preferably, in the insulating plug described above, the second electric terminal is also integrated with the insulating plug when injecting the synthetic resin into the mold.

DETAILED DESCRIPTION OF THE PREFERRED EMBODIMENT

An embodiment of the present invention will now be described.

Figure 1:
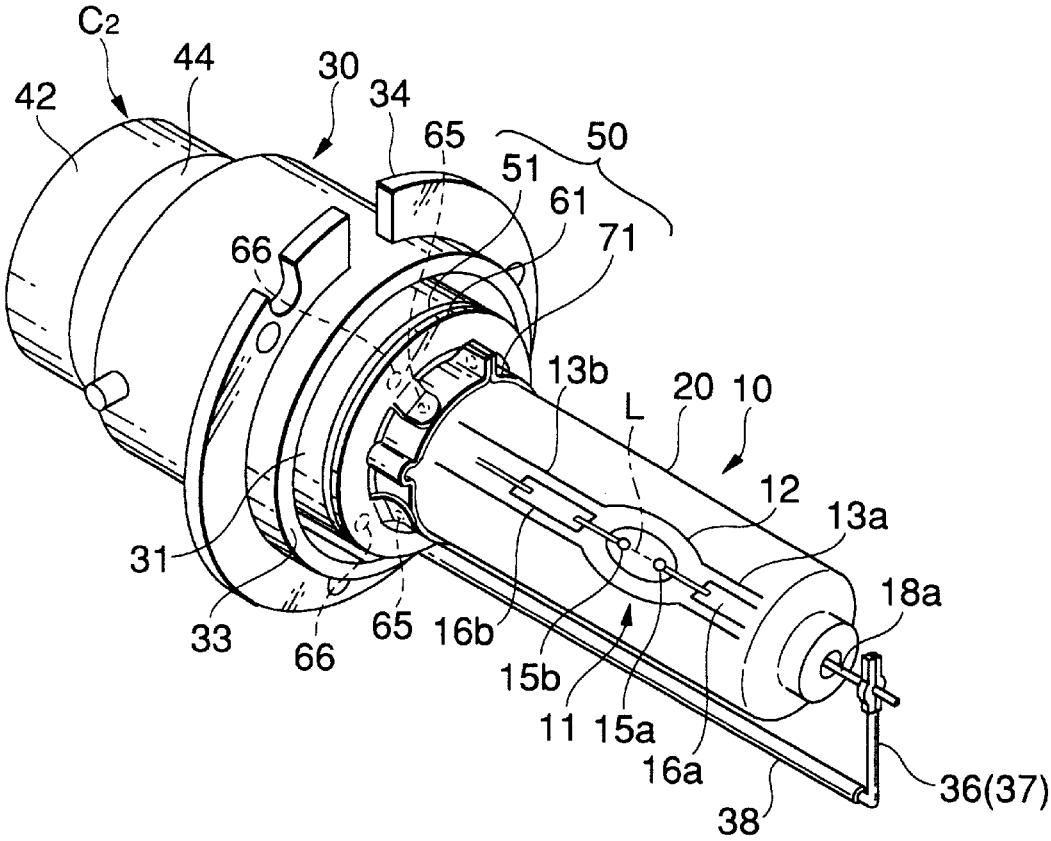
FIG. 1 is a perspective view showing an electric discharge lamp apparatus according to a first embodiment of the present invention.
Figure 2:
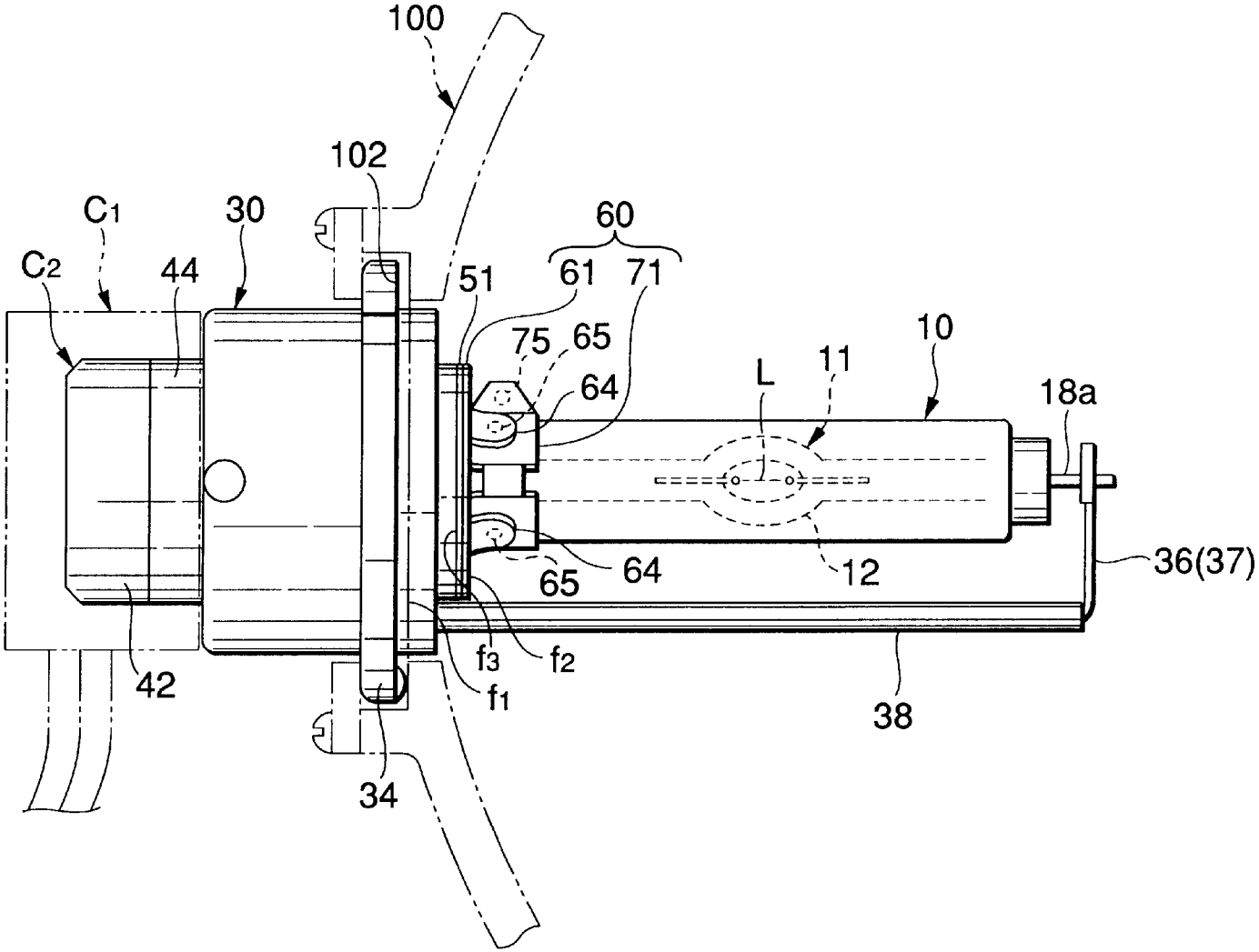
FIG. 2 is a side view showing the electric discharge lamp apparatus.
Figure 3:
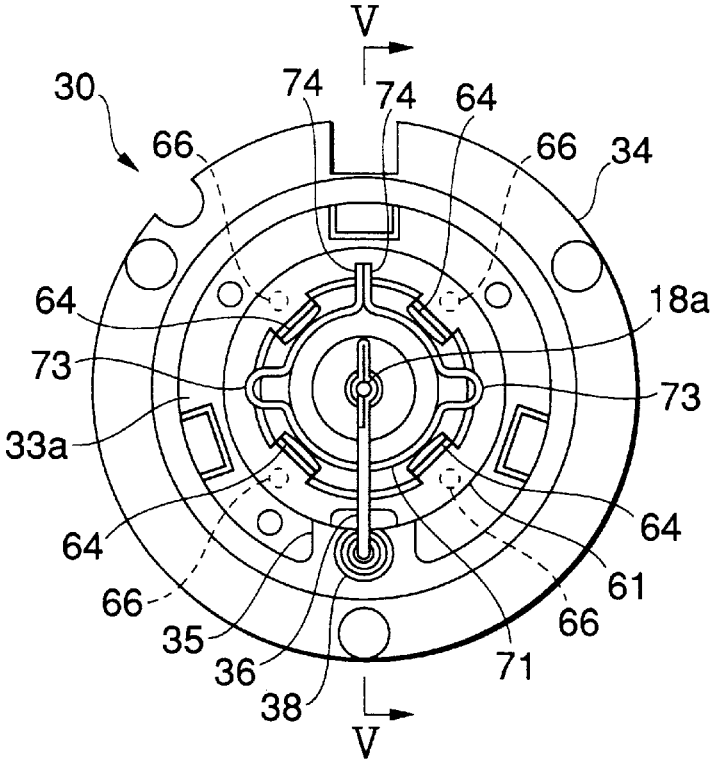
FIG. 3 is a front view showing the electric discharge lamp apparatus.
Figure 4:
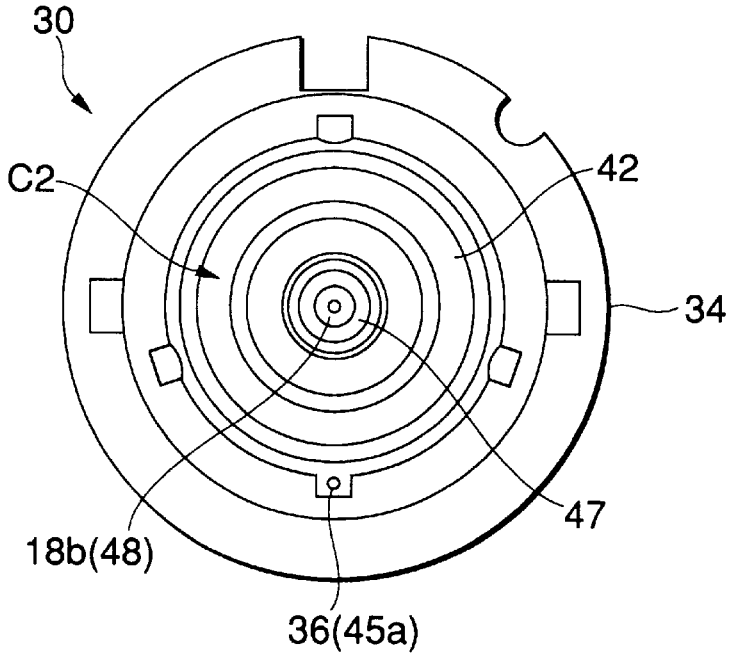
FIG. 4 is a rear view showing the electric discharge lamp apparatus.
Figure 5:
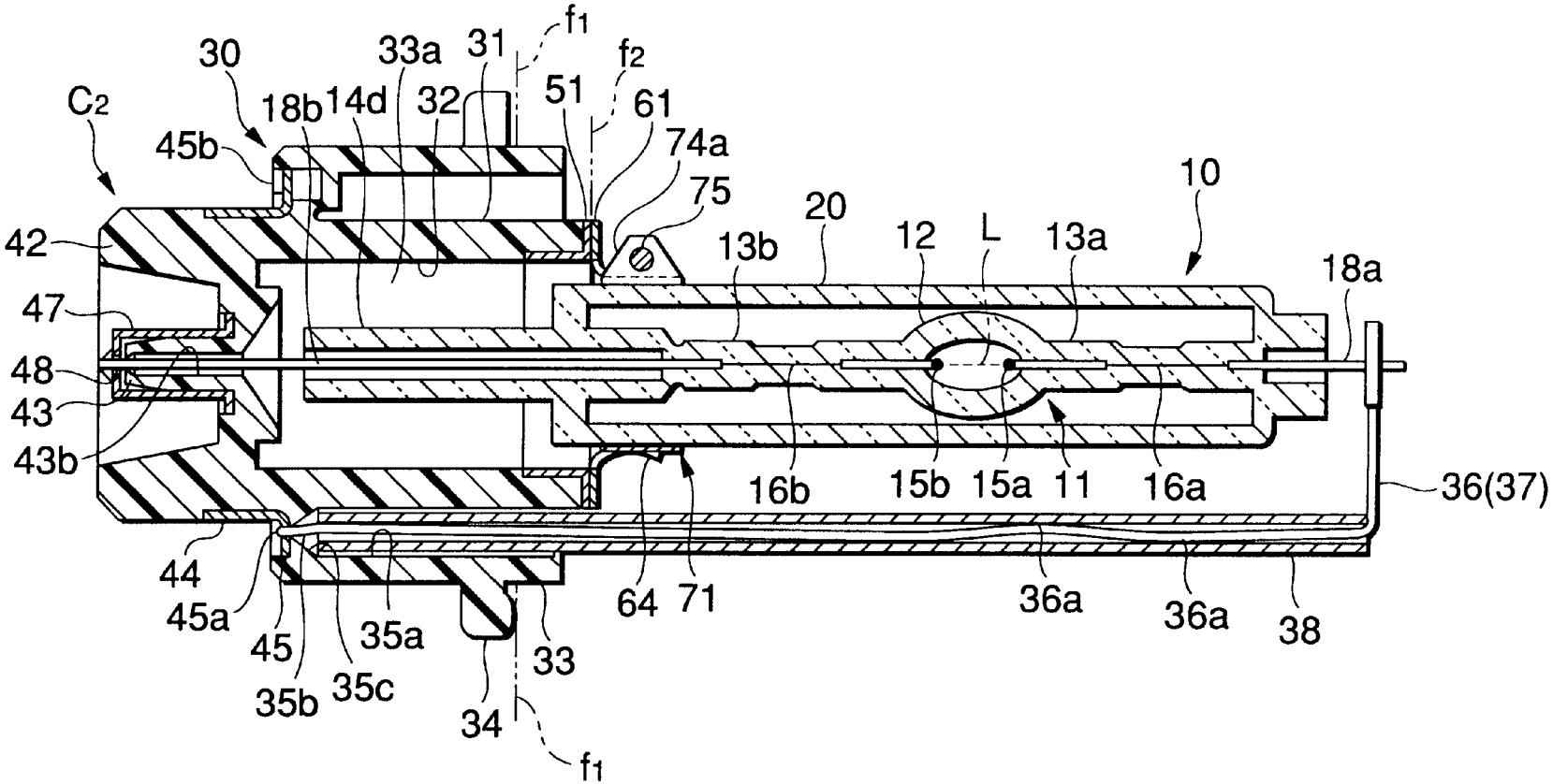
FIG. 5 is a vertical cross sectional view (a cross sectional view taken along line V—V shown in FIG. 3) showing the electric discharge lamp apparatus.
Figure 6:
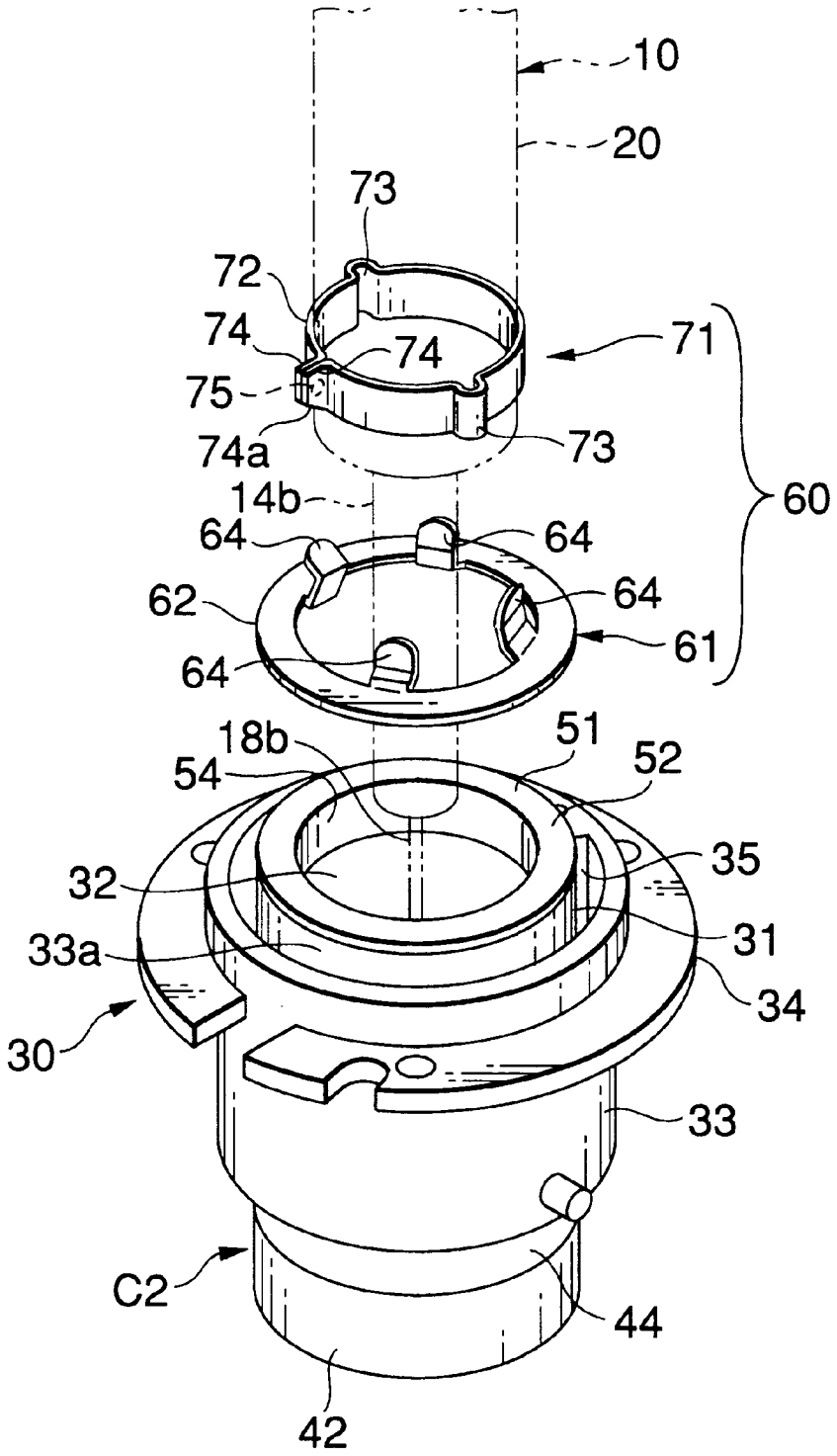
FIG. 6 is an exploded perspective view showing a vertically-holding member for holding an arc tube.
Figure 7:
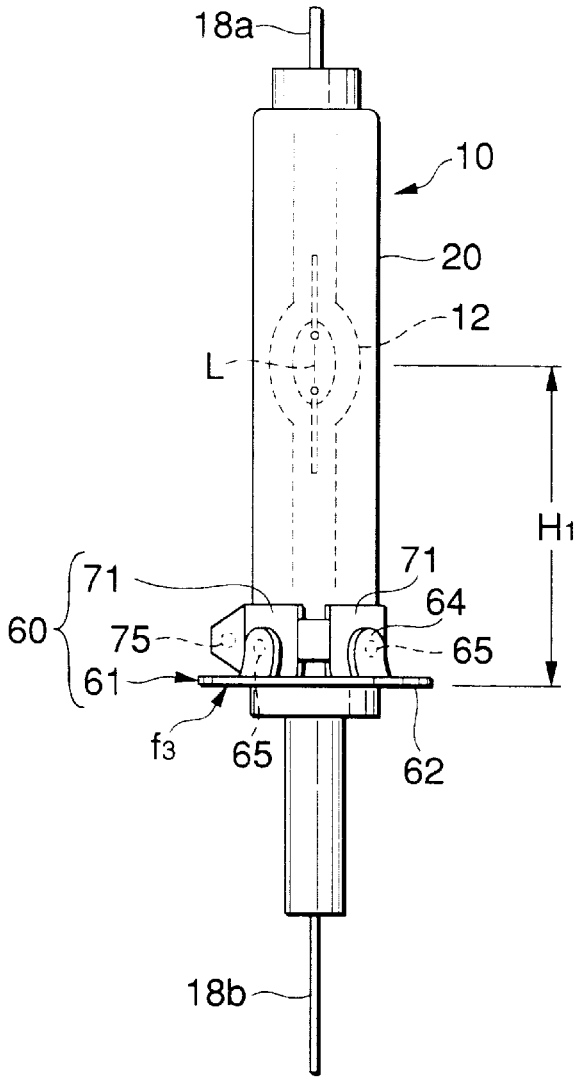
FIG. 7 is a side view showing the arc tube to which the vertically-holding member has been secured and integrated.
Figure 8:
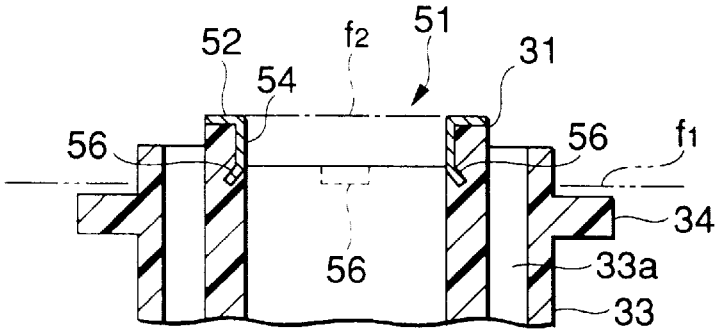
FIG. 8 is a vertical cross sectional view showing the front surface of an insulating plug to which the base plate has been secured and integrated.
Figure 9:
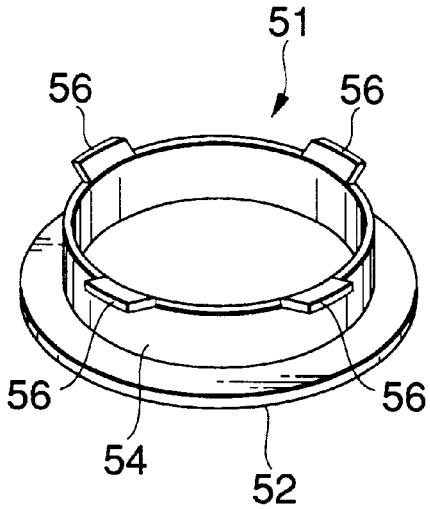
FIG. 9 is a rear perspective view showing a base plate.
Figure 10:
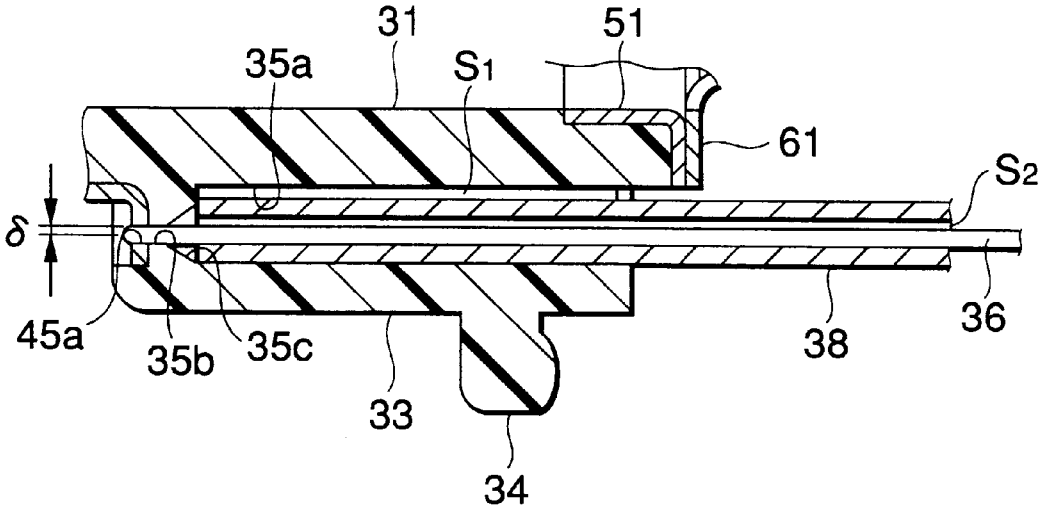
FIG. 10 is an enlarged cross sectional view showing a portion in the vicinity of the sleeve insertion hole.
Figure 11:
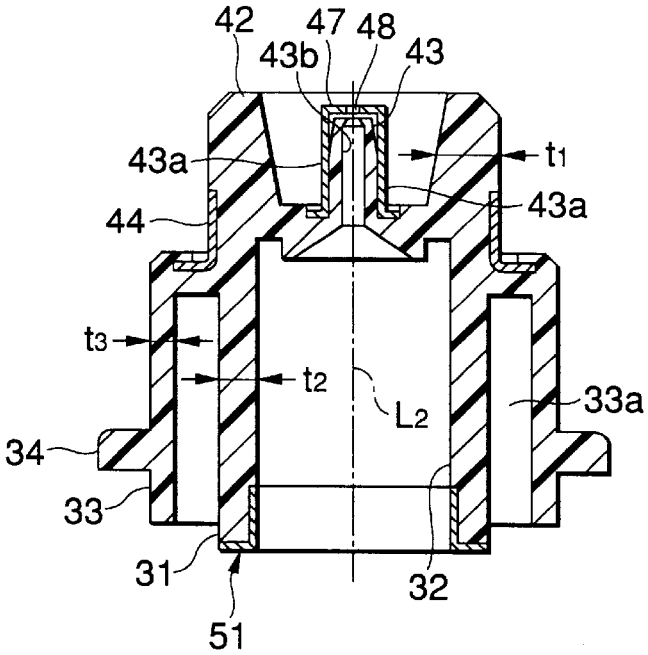
FIG. 11 is a vertical cross sectional view showing an insulating plug having a rear end facing upwards.
Figure 12:
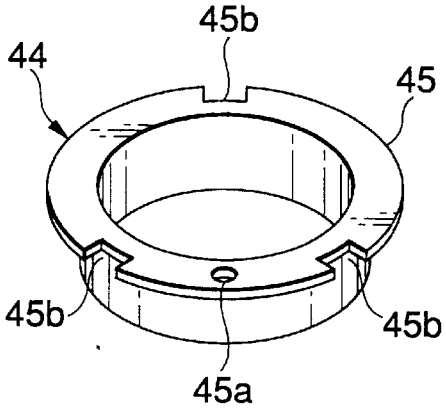
FIG. 12 is a rear perspective view showing a cap-type terminal.
Figure 13:
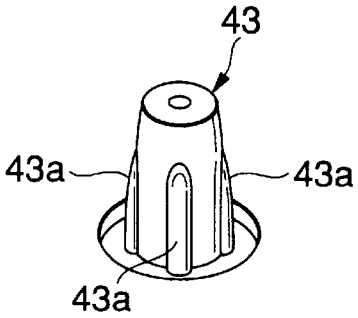
FIG. 13 is a plug showing a boss to which the cap-type terminal is fitted.
Figure 14:
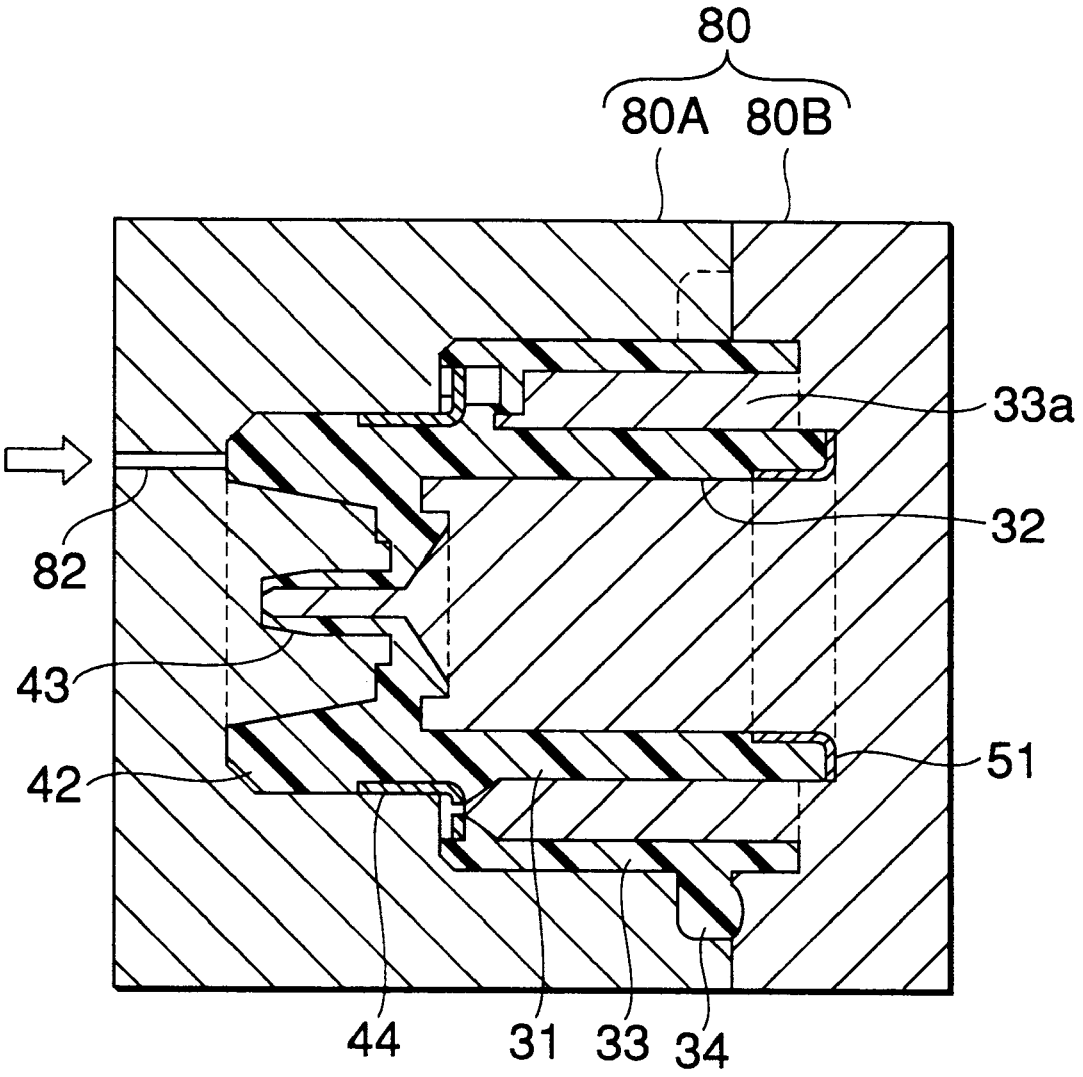
FIG. 14 is a cross sectional view showing a mold for injection-molding an insulating plug body.

FIGS. 1 to 14 show a first embodiment of the present invention. FIG. 1 is a perspective view showing an electric discharge lamp apparatus to which an insulating plug according to the first embodiment of the present invention is applied. FIG. 2 is a side view showing the electric discharge lamp apparatus. FIG. 3 is a front view showing the electric discharge lamp apparatus. FIG. 4 is a rear view showing the electric discharge lamp apparatus. FIG. 5 is a vertical cross sectional view (a cross sectional view taken along line V-V shown in FIG. 3) showing the electric discharge lamp apparatus. FIG. 6 is an exploded perspective view showing a vertically-holding member for holding an arc tube. FIG. 7 is a side view showing the arc tube to which the vertically-holding member has integrally been secured. FIG. 8 is a vertical cross sectional view showing a front end portion of an insulating plug to which a base plate has integrally been secured. FIG. 9 is a rear perspective view showing the base plate. FIG. 10 is an enlarged cross sectional view showing a portion in the vicinity of a sleeve insertion hold. FIG. 11 is a vertical cross sectional view showing the insulating plug having a rear end facing upwards. FIG. 12 is a rear perspective view showing a belt-type terminal. FIG. 13 is a perspective view showing a boss to which the cap-type terminal is fitted. FIG. 14 is a cross sectional view showing a mold for injection-molding the insulating plug body.

Referring to the drawings, an insulating plug 30 is made of synthetic resin. A lamp-side connector C2 at a rear end of the insulating plug 30 to which a power-supply-side connector C1 (see FIG. 2) can be connected and disconnected is integrally formed. Moreover, the insulating plug 30 has a focusing ring 34 provided for the outer surface thereof, the focusing ring 34 defining a contact reference surface f1 (see FIGS. 2 and 5) which is engaged to a valve insertion hole 102 (see FIG. 2) of a reflector 100 of a headlamp for an automobile. In front of the insulating plug 30, a lead support 36 forwards extending from the plug 30 and a metal support member 50 secured to the front surface of the plug 30 secure and support the arc tube 10. Thus, the electric discharge lamp apparatus is constituted.

That is, an inner cylindrical portion 31 having a front surface on which a base plate 51 is exposed forwards and a focusing ring 34 are disposed in the peripheral portion of the front end of the plug 30, the inner cylindrical portion 31 being opened forwards. Moreover, an outer cylindrical portion 33 surrounding the inner cylindrical portion 31 and opened forwards is provided for the front end portion of the plug 30. A lead wire 18*a* extending from the front end of the arc tube 10 is, by spot welding, secured to a bent leading end 37 of a lead support 36 forwards projecting over the plug 30. Moreover, the rear end of the arc tube 10 is held by a metal vertical holding member 60 comprising a slide plate 61 and an arc-tube holding band 71 welded and secured to the base plate 51 exposed in the front surface of the inner cylindrical portion 31.

The arc tube 10 has a structure that a cylindrical ultraviolet-ray shielding globe 20 is welded (hermetically joined) to an arc tube body 11 which incorporates an enclosed glass bulb 12 in which tungsten electrodes 15*a* and 15*b* are disposed opposite to each other. Thus, the enclosed glass bulb 12 is surrounded and hermetically sealed by the ultraviolet-ray shielding globe 20. An electrically discharging axis L connecting the tungsten electrodes 15*a* and 15*b* to each other is indicated in FIGS. 1,2,5 and 7.

The arc tube body 11 has the enclosed glass bulb 12 manufactured from cylindrical pipe shape quartz glass tube, held between pinch seal portions 13*a* and 13*b* each having a rectangular lateral cross sectional shape at a predetermined position in the lengthwise direction and formed into a rotative elliptic shape. In the glass bulb 12, starting rare gas, mercury and metal halide, for example, sodium-scandium light emitting substances, are enclosed. Molybdenum foil members 16*a* and 16*b* each of which is formed into a rectangular shape is hermetically bonded on the pinch seal portions 13*a* and 13*b*. Tungsten electrodes 15*a* and 15*b* disposed opposite to each other in the enclosed glass bulb 12 are connected to either one of the molybdenum foil members 16*a* and 16*b*, while lead wires 18*a* and 18*b* extending outwards from the arc tube body 11 are connected to the other one of the molybdenum foil members 16*a* and 16*b*.

The cylindrical globe 20 for shielding ultraviolet-ray having an inner diameter larger than the diameter of the enclosed glass bulb 12 is, by welding, integrated to the arc tube body 11. Regions of the arc tube body 11 from the pinch seal portions 13*a* and 13*b* to the enclosed glass bulb 12 are surrounded and hermetically sealed by the globe 20. Moreover, a rearwardly-extending portion 14*b* (see FIG. 5) of the arc tube body 11 which is formed into a cylindrical pipe shape and which is a non pinch seal portion extends rearwards from the globe 20.

The globe 20 is made of quartz glass into which $TiO_2$ and $CeO_2$ has been doped and which has an ultraviolet-ray shielding effect. Thus, ultraviolet rays of light can reliably be removed which have been emitted by the enclosed glass bulb 12, which is the electric discharge portion in predetermined regions harmful to the human body. The inside portion of the globe 20 is made to be vacuum or in a state in which inert gas has been enclosed. Thus, the globe 20 has a heat insulating action for insulating heat radiated from the enclosed glass bulb 12 which is the electric discharge portion. As a result, the characteristics of the lamp are not affected by dint of change in the external environment.

Therefore, the metal members, such as the lead support 36 and the slide plate 61, are irradiated with light allowed to pass through the ultraviolet-ray shielding film, that is, light from which the ultraviolet rays in a predetermined wavelength region have been cut. Thus, the quantity of free electrons which are excited and thus discharged to the outside of the metal members can be reduced. As a result, the problem in that the steam pressure of the light emitting substance in the enclosed glass bulb 12 is reduced can be prevented.

The insulating plug 30 is manufactured by injection-molding synthetic resin. An opening 32 through which a rearwardly-extending portion 14*b* of the arc tube 10 can be inserted and in which the same can be accommodated is formed in the front-end inner cylindrical portion 31 of the plug 30. An outer cylindrical portion 33 having a focusing ring 34 disposed around the circumferential periphery thereof is formed around the inner cylindrical portion 31 except for a bridge portion 35 (see FIGS. 3 and 6) in which the sleeve insertion hole 35*a* is formed. Thus, the synthetic resin for forming the plug 30 can be saved. That is, a cylindrical space 33*a* having a C-shape lateral cross section is formed between the inner cylindrical portion 31 and the outer cylindrical portion 33. As a result, the resin material corresponding to the space 33*a* can be saved and thus the weight of the plug 30 can be reduced.

The metal base plate 51 defining the reference plane is hermetically secured to the front end of the inner cylindrical portion 31. As shown in FIGS. 6, 8 and 9 which are enlarged views, the base plate 51 has a structure that a cylindrical portion 54 is provided for the inner end of the annular base portion 52. As shown in FIG. 14, insertion molding is performed such that injection molding is carried out in a state in which the base plate 51 is inserted into the mold 80. In this embodiment, the mold 80 comprising a stationary mold member 80A and a movable mold member 80B which is attached to and detachable from the stationary mold member 80A. Thus, an integrated form is realized in which the annular base portion 52 is exposed to the insulating plug 30. Four folded portions 56 bent outwards are provided for the leading end of the cylindrical portion 54 at the same intervals in the circumferential direction. The folded portions 56 are embedded in the inner cylindrical portion 31 of the insulating plug to serve as separation stoppers. Thus, the base plate 51 is firmly integrated and secured to the inner cylindrical portion 31. Therefore, there is no risk of the separation, for example, exfoliation, of the base plate 51 from the insulating plug 30.

The front surface of the annular base portion 52 of the base plate 51 integrated with the insulating plug 30 is formed into reference plane f2 (see FIGS. 2 and 8) running parallel to reference plane f1 (see FIGS. 2 and 5) of the focusing ring 34 which is a positioning reference member with respect to the reflector 100. A metal vertical holding member 60 including a metal slide plate 61 and a metal arc-tube holding band 71 and arranged to vertically hold the globe 20 of the arc tube 10 is welded and secured to the upper surface of (the base portion 52 of) the base plate 51. As a result, the electrically discharging axis L of the arc tube 10 is brought to a predetermined position on the central axis L2 (see FIGS. 2 and 11) of the focusing ring 34.

That is, as shown in FIG. 6, the arc-tube holding band 71 constituting the vertically-holding member 60 has rectangular tag-shape members 74 each of which is folded to have an L-shape cross section and formed at each of the two abutting portions of an elongated band body 72. When the tag-shape members 74 of the band body 72 wound around the globe 20 of the arc tube 10 are caused to abut against each other so as to be spot-welded at a spot welding portion 75, the arc-tube holding band 71 can be wound around the globe 20 so as to be secured to the globe 20.

Folded portions 73 are formed in the lengthwise direction of the band body 72. When the folded portions 73 are elastically deformed, the band body 72 is contracted in the lengthwise direction. Thus, the band body 72 can be wound around the globe 20 so as to be secured to the globe 20.

As shown in FIGS. 6 and 7, the metal slide plate 61 constituting the vertically-holding member 60 is formed into an annular shape having a base portion 62 which matches the base 52 of the base plate 51. Four tag-shape holding members 64 in the form of leaf springs arranged to be stood erect by cutting are formed at the same intervals in the circumferential direction of the inner end of the base portion 62. The outer surface of the arc-tube holding band 71 wound around the globe 20 of the arc tube 10 and thus secured to the globe 20 is held between the tag-shape holding members 64. Moreover, the tag-shape holding members 64 are laser-welded at laser-welded portions 65 to the arc-tube holding band 71. Thus, the arc tube 10 is integrated with the slide plate 61 in such a manner that the electrically-discharge axis L of the arc tube 10 is perpendicular to a joining surface f3, i.e. a bottom surface of the base portion 62 of the slide plate 61 (see FIG. 7) of the slide plate 61 with the base plate 51 and apart from the bottom surface f3 of the base portion 62 for a predetermined distance H1.

The slide plate 61 of the vertically-holding member 60 to which the arc tube 10 has been integrated is slidingly moved said along the base portion 52 of the base plate 51. When the electrically-discharging axis L has coincided with the central axis (the central axis of the electric discharge lamp apparatus) L2 of the focusing ring 34, (the base portion 62 of) the slide plate 61 is laser-welded to (the base portion 52 of) the base plate 51. Thus, the arc tube 10 is integrated with the insulating plug 30 through the vertically-holding member 60. Thus, the electrically-discharging axis L of the arc tube 10 is brought to a required position with respect to the focusing ring 34.

An insulating sleeve 38, into which the lead support 36 is inserted, which is formed into a cylindrical pipe shape and which is made of ceramic, is inserted into the sleeve insertion hole 35*a* opened in the front surface of the insulating plug 30. An insertion end of the lead support 36 which has penetrated the insulation sleeve 38 is inserted and laser-welded to a lead-support engaging hole 45*a* of a belt-type terminal 44 which rearwards projects from a lead-support insertion hole 35*b* (see FIG. 5) formed in the bottom portion of the sleeve insertion hole 35*a* and penetrating the rear portion of the insulating plug 30 and which is disposed at the rear end of the insulating plug 30.

The insulating sleeve 38 is disposed to cover the substantially overall region of a straight portion of the lead support 36 which constitutes a first electric passage for electric power, for instance, the positive-side passage in this embodiment. Thus, insulation from the lead wire 18*b* at the rear end of the arc tube 10 which constitutes a positive-side passage for electric power can be maintained.

As shown in FIG. 10 in an enlarged manner, a tapered hole 35*c* extending to the lead-support insertion hole 35*b* is formed in the bottom portion of the sleeve insertion hole 35*a*. The insertion end of the lead support which has penetrated the insulating sleeve 38 is guided by the tapered hole 35*c* so as to be introduced into the lead-support insertion hole 35*b*. Therefore, the operation for inserting the lead support 36 into the lead-support insertion hole 35*b* can easily be performed.

The lead support 36 is bent at a substantially right angle toward the central axis of the insulating plug 30 at a position at which the lead support 36 is exposed over the front end of the insulating sleeve 38. The front end portion of the arc tube 10 is supported by the bent portion 37. Waveform bent portions 36*a* are provided for the straight portion of the lead support in the insulation sleeve 38 adjacent to the front end. In a state where the lead support 36 has been inserted into the insulation sleeve 38, the bent portions 36*a* are in hermetically contact with the inner surface of the insulation sleeve 38. Therefore, the lead support 36 and the insulation sleeve 38 are integrated with each other. Thus, relative movement between the insulation sleeve 38 and the lead support 36 causing rattle can be prevented.

A cylindrical portion 42 extending rearwards and a cylindrical boss 43 extending rearwards in the cylindrical portion 42 are formed at the rear end of the insulating plug 30. The cylindrical belt-type terminal 44 serving as a second electric terminal, for instance a negative-side terminal in this embodiment, of the lamp-side connector C2 is integrally secured to the outer surface of the base portion of the cylindrical portion 42. Moreover, a cap-type terminal 47 serving as a first electric terminal, for instance a positive-side terminal in this embodiment, of the lamp-side connector is integrally fit to the boss 43.

As shown if FIG. 12, the belt-type terminal 44 has a cylindrical shape provided with an outward flange 45. As shown in FIG. 14, the belt-type terminal 44 which is to be integrated with the plug 30 is set within the mold members 80A. Then, the injection molding is carried out to form the plug 30. Consequently, the plug 20 with which the belt-type terminal 44 is integrated is obtained. The outward flange 45 has an engaging hold 45*a* to which a rear end of the lea support 36, which has penetrated the insulating plug 30, is secured by laser-welding. Moreover, three cut portions 45*b* for bringing the belt-type terminal 44 into a predetermined circumferential direction with respect to the insulating plug 30 are, at the same intervals, provided for the outward flange 45 in the circumferential direction.

Four vertical ribs 43*a* extending in the axial direction are, at the same intervals, provided for the outer surface of the boss 43 in the circumferential direction. Therefore, the adhesive force of the cap-type terminal 47 fitted to the boss 43 can be enlarged. As a result, separation of the cap-type terminal 47 can be prevented. A lead-wire engaging hole 48 is formed in the upper surface of the cap-type terminal 47. Thus, the lead wire 18*b* extending from the rear end of the arc tube 10 and allowed to pass through the opening 32 of the insulating plug 30 and the lead-wire insertion hole 43*b* is engaged and laser-welded to the engaging hole 48.

Figure 15:
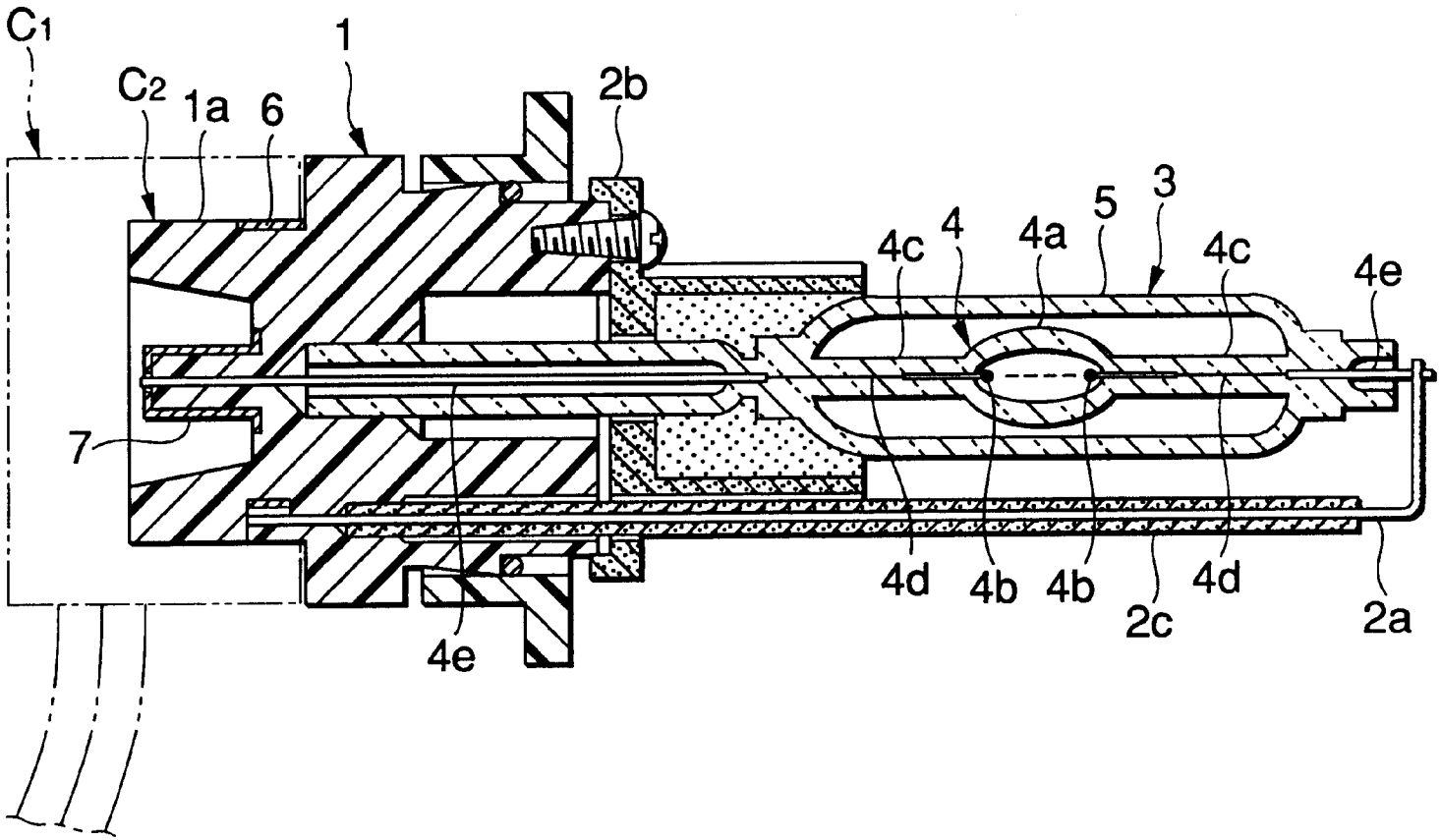
FIG.15 PRIOR ART
FIG. 15 is a vertical cross sectional view showing a conventional electric discharge lamp apparatus.
Figure 16:
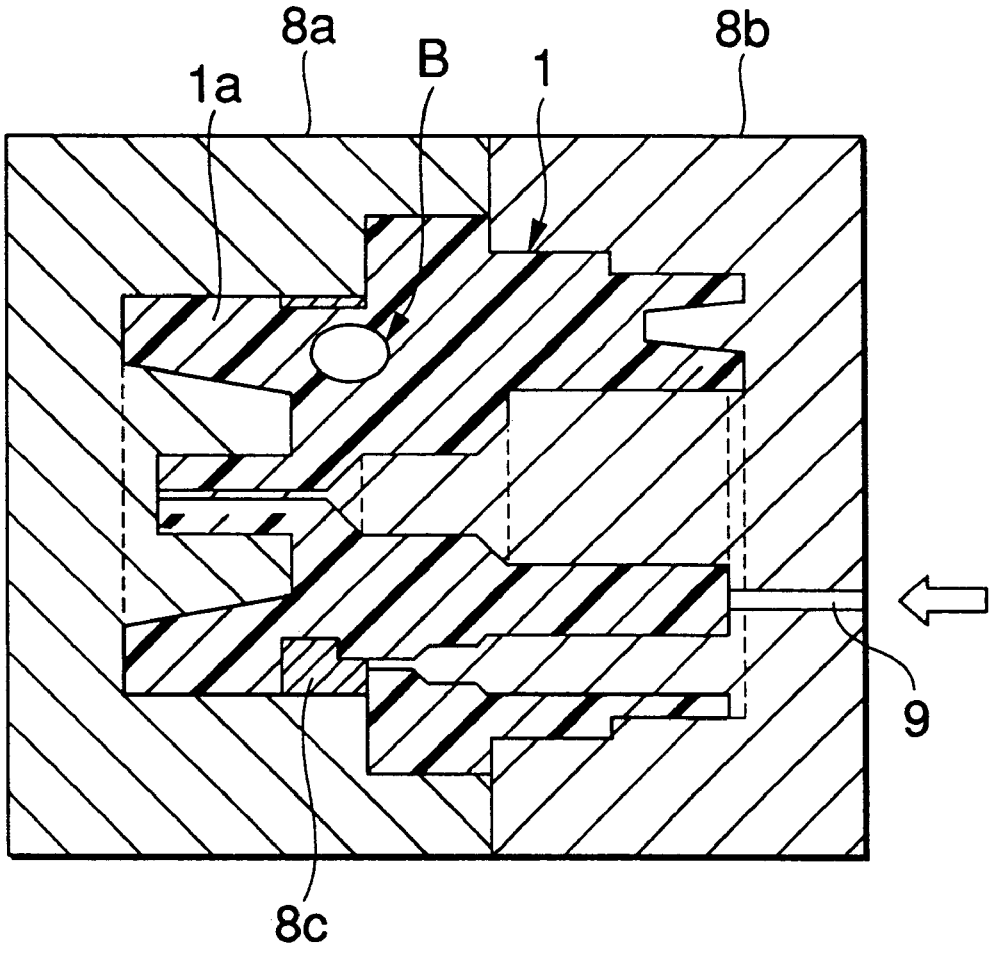
FIG.16 PRIOR ART
FIG. 16 is a cross sectional view showing a mold for injection-molding a conventional insulating plug for an electric discharge lamp apparatus.

As shown in FIG. 11, the inner cylindrical portion 31 and the outer cylindrical portion 33 are provided for the plug 30 at the positions adjacent to the front end of the plug 30. Moreover, the cylindrical portion 42 is formed at a position adjacent to the rear end of the plug 30. Thus, any portion has a substantially same thickness while no excessively large thickness is formed as has been experienced with the conventional plug (see FIGS. 15 and 16). Therefore, the resin injected into the cavity of the mold is contracted and solidified in substantially a predetermined period of time in any portion of the plug 30. As a result, local pulling of resin which occurs when it is contracted and solidified and which forms voids can be prevented.

The thicknesses t1, t2 and t3 of the rear-end cylindrical portion 42, the front-end inner cylindrical portion 31 and the front-end outer cylindrical portion 33 satisfy t1>t2>t3. Since the cylindrical portion 42 has the thickness which is reduced toward the rear end, the average thickness of the cylindrical portion 42 is made to be t1.

That is, the thickness of the rear-end cylindrical portion 42 is made to be the largest thickness t1 in the insulating plug 30 to maintain insulation between the belt-type terminal 44 molded integrally with the cylindrical portion 42 and allowed to appear outside and the cap-type terminal 47 exposed in the center of the cylindrical portion 42. Moreover, the mechanical strength which endures connection and disconnection of the connector C1 for supplying electric power can be realized.

The thickness of the front-end inner cylindrical portion 31 is made to be the thickness t2 next to that of the rear-end cylindrical portion 42. Thus, the insulation can be maintained between the rear-end lead wire 18*b* of the arc tube 10 which is the positive electricity passage disposed on the inside of the inner cylindrical portion 31 and the lead support 36 which is the negative electricity passage disposed on the outside of the inner cylindrical portion 31. Moreover, the mechanical strength capable of securing and holding the rear end of the arc tube 10 can be realized.

Since the front-end outer cylindrical portion 33 is a portion which does not considerably affect the insulation, the thickness of the outer cylindrical portion 33 is made to be the smallest thickness in the insulating plug 30 to create the space from the front-end inner cylindrical portion 31. To maintain the mechanical strength to integrally support the focusing ring 34 which is inserted into the valve insertion hole of the reflector of a headlamp for an automobile, the thickness is made to be the thickness t3.

As shown in FIG. 14, the insulating plug 30 is molded such that the extending end surface of the cylindrical portion 42 having the largest thickness faces the gate 82 of the mold member 80A. While plural gates, for instance three gates, may be provided, one of gates 82 is indicated in FIG. 14. Since the rear-end cylindrical portion 42 adjacent to the gate 82 has the structure that the resin passage in the cavity has a large cross sectional area, resin can smoothly be injected. Since the rear-end cylindrical portion 42 is formed adjacent to the gate, a high injection molding pressure is supplied. Therefore, there is no apprehension that a void is formed in the rear-end cylindrical portion 42.

On the other hand, the inner cylindrical portion 31 and the outer cylindrical portion 33 which constitute the front-end cylindrical portion are formed apart from the gate 82. However, the resin injected through the gate 82 is injected through the rear-end cylindrical portion 42 having the fluid passage having a large cross sectional area. Moreover, the thickness of the foregoing portion is small as compared with that of the rear-end cylindrical portion 42. Therefore, reduction in the injection molding pressure can be prevented. As a result, the resin can smoothly be injected to the ends of the inner and outer cylindrical portions 31 and 33. Therefore, there is no apprehension that a void is formed in the inner and outer cylindrical portions 31 and 33.

The three gates 82 are provided for the stationary-side mold 80A at positions on the extending end surface of the rear-end cylindrical portion 42 at the same intervals in the circumferential direction. Therefore, the resin injected into the cavity through each gate is uniformly introduced from the rear-end cylindrical portion 42 into the front-end cylindrical portion (the inner cylindrical portion 31 and the outer cylindrical portion 33) so as to be injected. Since a sufficiently high molding pressure acts, there is no apprehension that a void is formed in the inner cylindrical portion 31 and the outer cylindrical portion 33.

As can be understood from the description, the insulating plug for an electric discharge lamp apparatus according to the embodiment of the present invention has the structure that the portions of the insulating plug have substantially uniform thicknesses to prevent excessively large thickness. Therefore, a void can be prevented and satisfactory insulation between the positive terminal and the negative terminal can be realized.

The insulating plug body is molded such that the extending end surface of the rear-end cylindrical portion having the largest thickness in the insulating plug body faces the gate of the mold. Therefore, injection of the resin into the overall body of the cavity in the mold can smoothly be performed. Therefore, any void can be prevented in the insulating plug body. As a result, an insulating plug for an electric discharge lamp apparatus exhibiting excellent insulating performance can be provided.

Moreover, the synthetic resin material can be saved in a quantity corresponding to the space created between the inner cylindrical portion and the outer cylindrical portion at the front end of the insulating plug body. Moreover, the weight can be reduced. As a result, a light weight and low cost insulating plug for an electric discharge lamp apparatus can be provided.

Furthermore, injection of the resin into the ends of the cavity in the mold can furthermore smoothly be performed. Since there is no apprehension that a void is formed in the insulating plug body, an insulating plug for an electric discharge lamp apparatus exhibiting excellent insulation performance can be provided.

Still further, the thicknesses of the rear-end cylindrical portion and the front-end inner cylindrical portion, which must have satisfactory insulation characteristic and great mechanical strength, are enlarged. Moreover, the thickness of the front-end outer cylindrical portion which does not considerably affect the insulation is reduced. Thus, injection of the resin can significantly smoothly be performed. As a result, any void can reliably be prevented, the synthetic resin material can considerably be saved and the weight of the insulating plug, that is, the weight of the electric discharge lamp apparatus can be reduced.

What is claimed is:

1. An insulating plug for an electric discharge lamp apparatus, comprising:

a front portion includes an outer cylindrical portion and an inner cylindrical portion, said inner cylindrical portion having a substantially unique thickness and an opening to receive an arc tube of an electric discharge lamp;

a focusing ring extending from said outer cylindrical portion of said front portion; and a rear portion having a rear-end cylindrical portion and a center portion, wherein a thickness t1 of said rear-end cylindrical portion of said rear portion, and said thickness t2 of said inner cylindrical portion of said front portion satisfy a following condition:

$$t1>t2.$$

2. The insulating plug according to claim 1, wherein said thickness t1 of said rear-end cylindrical portion of said rear portion, said thickness t2 of said inner cylindrical portion of said front portion and a thickness t3 of said outer cylindrical portion of said front portion satisfy a following condition:

$$t1>t2>t3.$$

3. The insulating plug according to claim 1, wherein said front portion, said focusing ring and said rear portion are integrally molded by injecting a synthetic resin into a mold from a gate of the mold, the gate facing said rear portion of said insulating plug.

4. The insulating plug according to claim 3, wherein the gate faces said rear-end cylindrical portion of said rear portion of said insulating plug.

5. The insulating plug according to claim 3, wherein the resin is injected from plural gates which face to said rear portion of said insulating plug, and which are formed at even intervals.

6. An insulating plug for an electric discharge lamp apparatus, comprising:

a front portion includes an outer cylindrical portion and an inner cylindrical portion, said inner cylindrical portion having a substantially unique thickness and an opening to receive an arc tube of an electric discharge lamp;

a focusing ring extending from said outer cylindrical portion of said front portion;

a rear portion having a rear-end cylindrical portion and a center portion;

a first electric terminal exposed around said rear-end cylindrical portion of said rear portion, wherein said first electric terminal is made of an electric conductive material; and a second electric terminal exposed around said center portion of said rear portion, wherein said second electric terminal is made of an electric conductive material, and at least said first electric terminal is integrated with said insulating plug by injecting the synthetic resin into the mold.

7. The insulating plug according to claim 6, wherein said second electric terminal is also integrated with said insulating plug by injecting the synthetic resin into the mold.

8. An electric discharge lamp apparatus comprising:

an arc tube;

a front portion includes an outer cylindrical portion and an inner cylindrical portion, said inner cylindrical portion having a substantially unique thickness and an opening to receive said arc tube;

a focusing ring extending from said outer cylindrical portion of said front portion; and a rear portion having a rear-end cylindrical portion and a center portion, wherein a thickness t1 of said rear-end cylindrical portion of said rear portion, and said thickness t2 of said inner cylindrical portion of said front portion satisfy a following condition:

$$t1>t2.$$

9. The electric discharge lamp apparatus according to claim 8, wherein said thickness t1 of said rear-end cylindrical portion of said rear portion, said thickness t2 of said inner cylindrical portion of said front portion and a thickness t3 of said outer cylindrical portion of said front portion satisfy a following condition:

$$t1>t2>t3.$$

10. The electric discharge lamp apparatus according to claim 8, wherein said front portion, said focusing ring and said rear portion are integrally molded by injecting a synthetic resin into a mold from a gate of the mold, the gate facing said rear portion of said insulating plug.

11. The electric discharge lamp apparatus according to claim 10, wherein the gate faces said rear-end cylindrical portion of said rear portion of said insulating plug.

12. The electric discharge lamp apparatus according to claim 10, wherein the resin in injected from plural gates which face to said rear portion of said insulating plug, and which are formed at even intervals.

13. The electric discharge lamp apparatus according to claim 8, further comprising:

a first electric terminal exposed around said rear-end cylindrical portion of said rear portion, wherein said first electric terminal is made of an electric conductive material; and a second electric terminal exposed around said center portion of said rear portion, wherein said second electric terminal is made of an electric conductive material, and at least said first electric terminal is integrated with said insulating plug at injecting the synthetic resin into the mold.

14. The electric discharge lamp apparatus according to claim 13, wherein said second electrical terminal is also integrated with said insulating plug by injecting the synthetic resin into the mold.

15. The insulating plug according to claim 1, wherein a space is provided between said outer cylindrical portion and said inner cylindrical portion of said front portion, and said center portion of said rear portion is a boss which projects in the center of said rear-end cylindrical portion of said rear portion.

16. An insulating plug for an electric discharge lamp apparatus, comprising:

a front portion having an outer cylindrical portion and an inner cylindrical portion; and a rear portion having a rear-end cylindrical portion and a center portion, wherein a thickness t1 of said rear-end cylindrical portion of said rear portion, and a thickness t2 of said inner cylindrical portion and a thickness t3 of said outer cylindrical portion of said front portion satisfy a following condition:

$$t1>t2>t3.$$

* * * * *